United States Patent [19]

O'Neill

[11] Patent Number: 4,705,086

[45] Date of Patent: Nov. 10, 1987

[54] WALLET FOR JOGGERS

[76] Inventor: James J. O'Neill, 37 South Washington Ave., Hartsdale, N.Y. 10530

[21] Appl. No.: 942,059

[22] Filed: Dec. 22, 1986

Related U.S. Application Data

[63] Continuation-in-part of Ser. No. 796,801, Nov. 12, 1985, abandoned.

[51] Int. Cl.[4] ..... A45C 1/06; A45C 11/32; A45C 13/18

[52] U.S. Cl. ..... 150/134; 150/137; 150/145; 206/37.1; 206/37.4; 224/240; 224/252; 224/269

[58] Field of Search ..... 150/102, 134, 137, 145; 224/240, 252, 253, 269, 901; 24/3 R, 3 H, 3 L, 3 M, 3 F; 206/37.1, 37.4

[56] References Cited

U.S. PATENT DOCUMENTS

| | | | |
|---|---|---|---|
| 649,217 | 5/1900 | Scherer | 224/252 |
| 882,493 | 3/1908 | Dodge . | |
| 889,436 | 6/1908 | Bustanoby | 150/134 X |
| 1,035,946 | 8/1912 | Cardwell | 150/137 |
| 1,107,958 | 8/1914 | Jorgensen | 150/134 X |
| 1,314,392 | 8/1919 | Glamzo . | |
| 1,555,714 | 9/1925 | Kahn | 150/134 X |
| 1,618,573 | 2/1927 | Cole | 224/252 X |
| 1,629,404 | 5/1927 | Mitchell | 224/240 |
| 1,652,972 | 12/1927 | Beck | 24/3 L |
| 1,679,606 | 8/1928 | Graves | 150/134 X |
| 1,695,350 | 12/1928 | Shively | 150/134 X |
| 2,126,826 | 8/1938 | Shively | 150/134 X |
| 2,326,558 | 8/1943 | Pelz | 24/6 F |
| 2,567,602 | 9/1951 | Higgins | 150/134 X |
| 2,652,873 | 9/1953 | Barricini | 150/134 |
| 2,834,389 | 5/1958 | Major | 150/134 |
| 3,147,896 | 9/1964 | Kehl | 150/134 X |
| 3,374,508 | 3/1968 | Slimovitz | 24/3 R |
| 4,044,933 | 8/1977 | Artz | 224/252 X |
| 4,060,876 | 12/1977 | De Soto | 224/252 X |
| 4,083,321 | 4/1978 | Le Bron et al. | 150/134 X |
| 4,174,793 | 11/1979 | Wisowaty | 224/240 |
| 4,201,259 | 5/1980 | Alsdorf | 150/134 |
| 4,209,048 | 6/1980 | Sandos | 150/132 |
| 4,226,006 | 10/1980 | Toyama | 24/3 L |
| 4,237,583 | 12/1980 | Sullivan | 150/134 X |
| 4,316,492 | 2/1982 | Plough et al. | 150/143 |
| 4,332,338 | 6/1982 | Christiansen | 150/143 X |
| 4,403,366 | 9/1983 | Lucke | 224/269 X |
| 4,416,315 | 11/1983 | Foley . | |
| 4,444,342 | 4/1984 | Powell | 224/252 X |
| 4,570,688 | 2/1986 | Williams | 150/134 |

FOREIGN PATENT DOCUMENTS

| | | | |
|---|---|---|---|
| 1108427 | 8/1955 | France | 150/132 |
| 2373988 | 8/1978 | France | 150/134 |
| 2427808 | 2/1980 | France | 24/3 L |

*Primary Examiner*—William Price
*Assistant Examiner*—Sue A. Weavers
*Attorney, Agent, or Firm*—Leo Zucker

[57] ABSTRACT

A wallet particularly suited to the needs of persons while jogging or participating in other active sports, includes a flexible back panel which is foldable between open and closed positions about a folding axis. A first flexible pocket panel is secured to the back panel on an inside surface portion on one side of the folding axis of the back panel. A second flexible pocket panel is secured to the back panel on an inside surface portion which is on the opposite side of the folding axis of the back panel. Both the first and second pocket panels have unsecured edges extending near the folding axis so as to define first and second pockets, respectively. A hook member projects out of the back panel and extends over an outside portion of the back panel to engage the waistband of the wearer. Accordingly, the wallet can be worn comfortably and its contents will not be lost.

18 Claims, 7 Drawing Figures

WALLET FOR JOGGERS

This application is a continuation-in-part of application Ser. No. 796,801, filed Nov. 12, 1985, now abandoned.

BACKGROUND OF THE INVENTION

1. Field of the Invention

The present invention relates generally to wallets, and more particularly to a wallet adapted to be worn while jogging or the like.

2. Description of the Known Art

With ever-increasing numbers of persons now participating in activities such as jogging, tennis, cycling and other sports for which normal street attire is inappropriate, a need has arisen for a wallet or billfold which can be worn by a person while engaged in such sports. A secure wallet pocket is usually absent from jogging suits, and tennis or cycling clothing.

Particularly in the case of jogging, it is important that a person carry some identification means and at least a small amount of currency with him or her, since the person may travel large distances from home during which time emergency situations calling for identification or currency may well occur.

Until now, joggers and others had to rely on small money bags or purses strapped to their wrists, and separate identification means such as a "dog tag" or bracelet in order to carry both currency and identification means with them at all times. Also, a wallet with an elastic strap which can be worn about the arm or leg is disclosed in U.S. Pat. No. 4,332,338 issued June 1, 1982. When the wallet of U.S. Pat. No. 4,332,338 is so worn, however, the wallet is held in an open position. Accordingly, items contained within the wallet are at great risk of loss, particularly with recurrent movement of the leg or arm on which the wallet is strapped while the wearer participates in an active sport.

Containers for carrying valuables which containers have fastening clips for attachment to an article of clothing are also known from, e.g., U.S. Pat. Nos. 4,416,315 issued Nov. 22, 1983, and 1,314,392 issued Aug. 26, 1919. The containers are not, however, configured to be worn conveniently while the wearer participates in an active sport, that is, the container may interfere with free movement of the wearer's body and/or become unfastened from the article of clothing to which it is clipped.

SUMMARY OF THE INVENTION

An object of the present invention is to overcome the above and other shortcomings in the known wallets for joggers, cyclers or other persons engaged in an active sport.

Another object of the invention is to provide a wallet which can be worn comfortably during active participation in a sport by the wearer.

Another object of the invention is to provide a wallet which can be worn in a concealed position on the body of the wearer.

A further object of the invention is to provide a wallet adapted to be worn while jogging or the like, which wallet can contain both identification means and currency in separate pockets.

Yet another object of the invention is to provide a wallet which can be worn comfortably in either a concealed position while jogging or the like, or a shirt or pants pocket when wearing normal street attire.

In accordance with the invention, a wallet adapted to be worn while jogging or the like includes a flexible back panel which is foldable between open and closed positions about a folding axis. A first flexible pocket panel is secured along peripheral edges thereof to an inside surface portion of the back panel, and a second flexible pocket panel is secured along peripheral edges thereof to another inside surface portion of the back panel, the inside surface portions on which the pocket panels are secured being on opposite sides of the folding axis of the back panel.

A hook member projects out of the back panel and extends over an outside portion of the back panel, and is adapted to clamp against the waistband of a wearer. The dimensions of the hook member and the back panel are such that the wallet can be worn securely and be substantially concealed between the waistband and the wearer's body with the wallet in a closed configuration.

In one embodiment, the hook member is detachable from an area of attachment on the back panel, and the hook attachment area blends smoothly with the surrounding portion of the back panel when the hook member is detached.

The various features of novelty which characterize the invention are pointed out with particularity in the claims annexed to and forming a part of the present disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
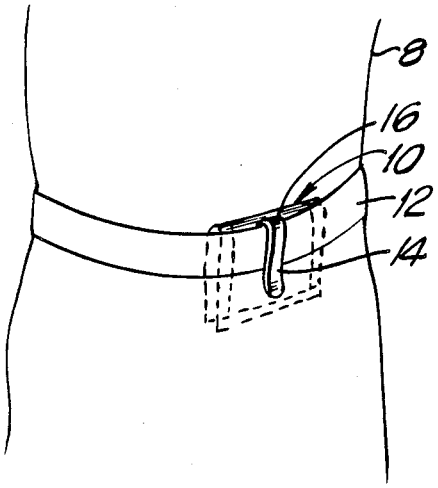
FIG. 1 is a view of the wallet according to one embodiment of the present invention, as fastened to the waistband of a wearer.
Figure 2:
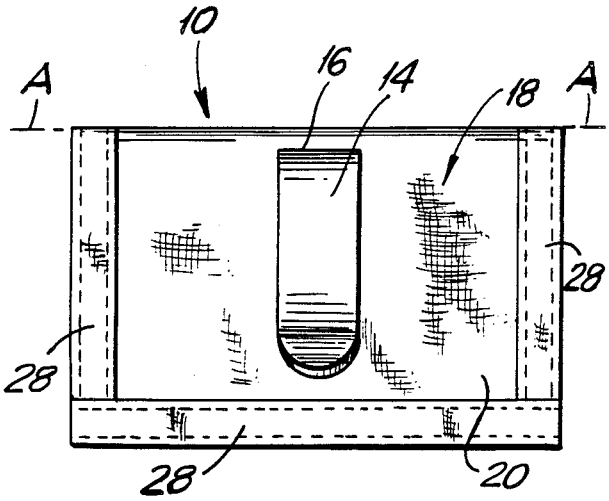
FIG. 2 is a plan view of the present wallet in a closed position, showing hook means extending over an outside portion of a back panel of the wallet.
Figure 4:
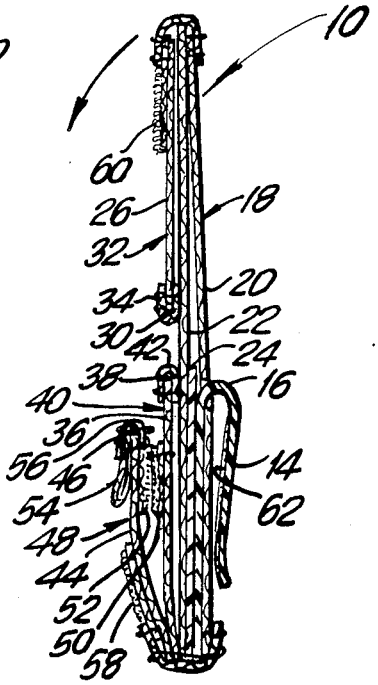
FIG. 4 is a sectional view taken along line 4—4 in FIG. 3.

FIG. 1 shows a wallet 10 according to the present invention as worn inside the waistband 12 of a wearer 8. An elongate hook member 14 projects from the wallet interior, through an opening in a back panel 18, and over the outside surface of the wallet 10, as shown in FIGS. 2 and 4. The hook member 14 has a closed end 16 arranged in the vicinity of a folding axis A which defines an edge of the wallet when the wallet 10 is closed as shown in FIG. 2.

Specifically, hook member 14 is generally U-shaped as shown in the drawing, with legs of a resilient material of a certain width as measured along the direction of the fold axis A in FIG. 2.

When worn on the waistband 12 as in FIG. 1, the waistband fits between the hook member 14 and the outside of the back panel 18 of the wallet up to the closed end 16 so that substantially the entire wallet 10 is concealed between the wearer's waistband 12 and his or her body. Preferably, the width center line of the hook member 14 is perpendicular to the center of the linear folded edge of the back panel 18, as in FIG. 2.

The overall dimensions of the hook member 14 and back panel 18 are such that they may be worn comfortably between the waistband 12 and the wearer's body while engaging in activities such as jogging, tennis, cycling or the like during which recurrent movement of the wearer's body in the vicinity of the waistband 12 is likely to occur. In a preferred embodiment, the length and width of the wallet 10 when closed as in FIG. 2 are about the same as that of a common playing card. Specific dimensions are given later below.

As shown more clearly in FIG. 4, the back panel 18 is comprised of two layers 20,22 of flexible material. A rigid support layer 24, such as a rectangular piece of cardboard, is disposed between the two flexible material layers 20,22 on the lower side of the folding axis A as viewed in FIG. 4. An inside leg of the hook member 14 extends between the support layer 24 and the flexible layer 20 of the back panel 18. An outer surface of the inside leg of the hook member 14 is adhered to a confronting surface on the rigid support layer 24.

Figure 3:
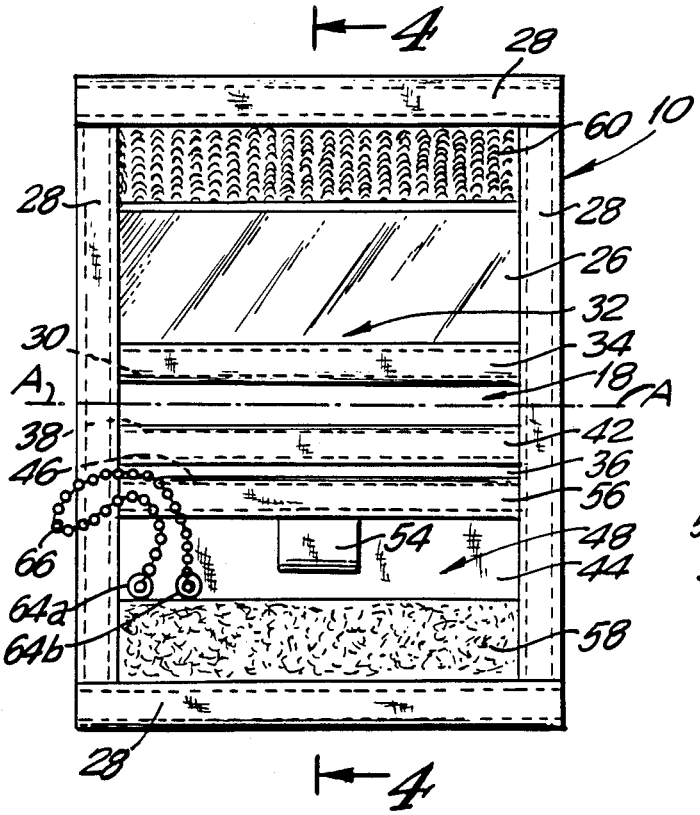
FIG. 3 is a plan view of the present wallet when unfolded to an open position.

FIG. 3 is a view of the interior of the wallet 10 when in an open position. In the disclosed embodiment, the opened wallet 10 is rectangular in shape, the back panel 18 forming the main body of the wallet 10 being, e.g., about 4.0 inches (10.16 cm) in length in the direction of the folding axis A, and about 5.5 inches (13.97 cm) in length in the direction perpendicular to the folding axis A.

A first flexible pocket panel 26 is secured at peripheral edges thereof to the back panel 18 such as by stitching through ribbon borders 28. An unsecured edge 30 of the first panel 26 extends near and generally parallel to the folding axis A to define a first pocket 32. A ribbon trim 34 is provided to cover the unsecured edge 30 of the first panel 26. Preferably, the panel 26 is transparent so as to allow an identification card inserted into the first pocket 32 to be viewed at once upon opening of the wallet 10.

A second flexible pocket panel 36 is secured at peripheral edges thereof to the back panel 18, also by way of stitching through the ribbon borders 28 as shown in FIG. 3. An unsecured edge 38 of the second pocket panel 36 extends near and generally parallel to the folding axis A to define a second pocket 40. The unsecured edge 38 is covered with a ribbon trim 42. The second pocket 40 may be used, for example, to carry paper currency which, when folded, will be held flat inside the second pocket 40.

Inasmuch as both the unsecured edges 30,38 of the first and second pockets 32,40 extend near the folding axis A of the back panel 18, it will be understood that when the wallet 10 is folded as in FIGS. 1 and 2, items contained in the first and second pockets will be prevented by the back panel 18 from escaping when the wallet 10 is subjected to recurrent or sudden movement.

A third flexible pocket panel 44 is secured along peripheral edges thereof to the second pocket panel 36, also by way of stitching through the ribbon borders 28. An unsecured edge 46 of the third pocket panel 44 extends beneath and parallel to the unsecured edge 38 of the second pocket panel 36, to define a third pocket 48. Sealing means such as a pair of confronting "VELCRO" strips 50,52 are provided on confronting surfaces of the second and third pocket panels 36,44, respectively, for sealing the third pocket 48 closed. Preferably, the sealing strip 52 associated with the third pocket panel 44 extends in the vicinity of the unsecured edge 46 of the third panel 44, so that items such as coins, keys and other personal articles will be allowed sufficient space within the third pocket 48 when that pocket is sealed closed. A lift tab 54 is fixed near the unsecured edge 46 of the third pocket panel 44, by stitching through ribbon trim 56 which covers the unsecured edge 46. The lift tab 54 enables an opening force to be applied to the third panel 44 so as to release the sealing strips 50,52 from one another and to open the third pocket 48.

In order to hold the back panel 18 securely in the closed position of FIG. 2, a pair of fastening or "VELCRO" strips 58,60 can be provided along confronting end portions of the third and first pocket panels 44,26, respectively, as shown in FIGS. 3 and 4.

The two flexible layers 20,22 of the back panel 18, the second pocket panel 36 and the third pocket panel 44 are preferably a nylon or similar fabric which permits air current flow through the fabric, thus minimizing the effects of perspiration from the wearer's body on the wallet 10. The hook member 14 can be comprised of any resilient, rust-resistant metal or plastics material. To ensure a firm grasp of the waistband 12 by the hook member 14, an abrasive such as a strip of emery 62 can be fixed on an inside surface of the outside leg of the hook member.

To facilitate carrying of keys in the third pocket 48, a pair of eyelets **64*a*,64*b* are provided close to one another through the third pocket panel 44 and near a side end of the panel 44. A key chain 66 is looped through the eyelets 64*a*,64*b*, so that one or more keys can be held by the chain 66, either while the keys are contained within the third pocket 48, or with the chain 66 brought outside the interior of the wallet 10** when a key is to be used.

Figure 5:
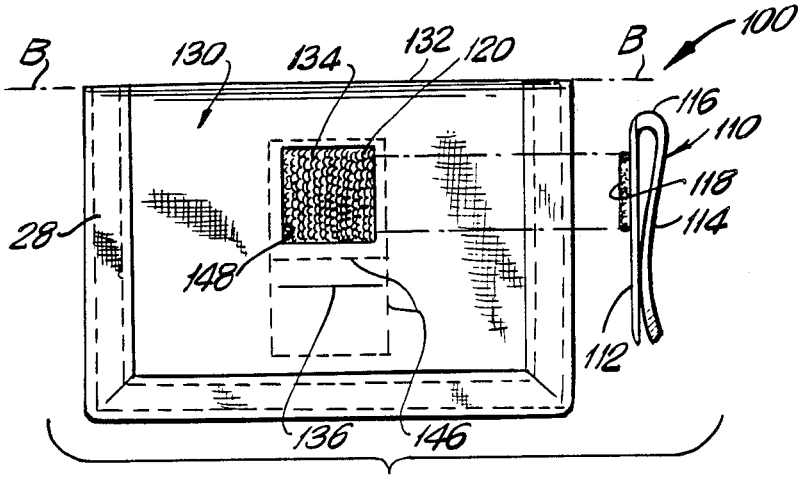
FIG. 5 is a plan view of a second embodiment of a wallet according to the invention, showing a detachable hook member.
Figure 6:
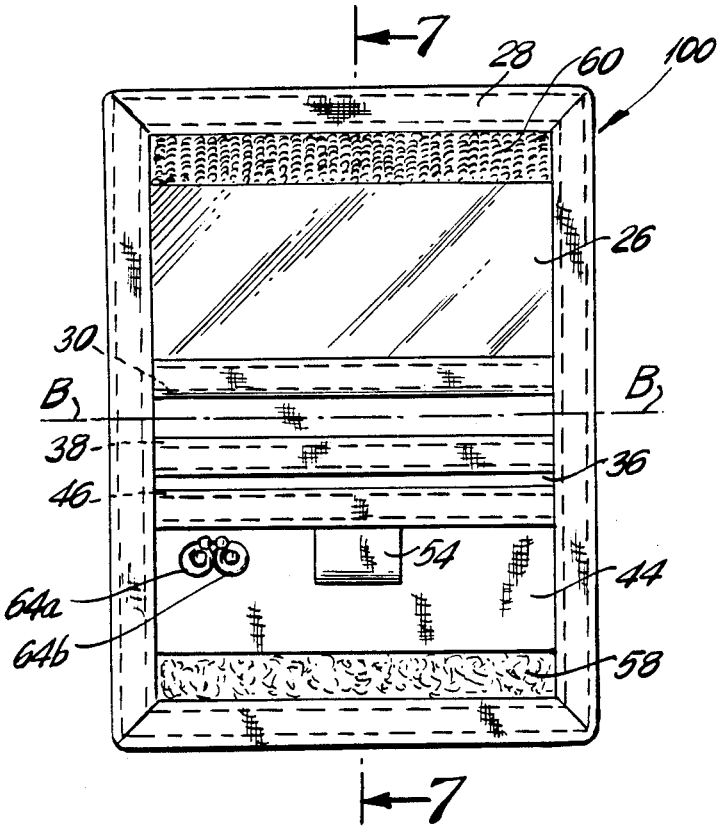
FIG. 6 is a plan view of the wallet of FIG. 5 when unfolded to an open position.
Figure 7:
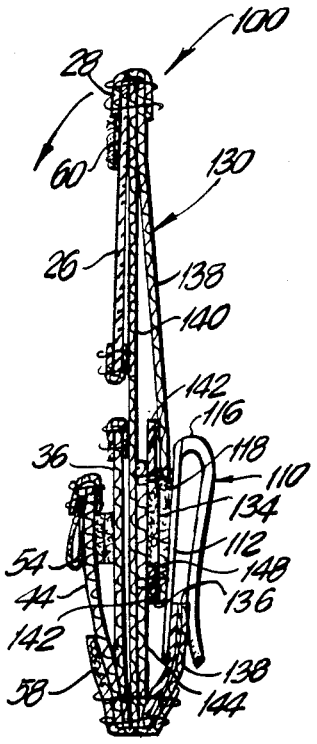
FIG. 7 is a sectional view taken along line 7—7 in FIG. 6.

FIGS. 5–7 illustrate a second embodiment in which a detachable hook member is provided to allow the present wallet to be worn comfortably in either a concealed position while jogging, or a shirt or pants pocket when wearing normal street attire.

FIG. 5 is a plan view of the wallet of the second embodiment in a closed position, with a detachable hook member 110 shown detached from an attachment area 120 formed in the outside surface of a back panel 130 of the wallet 100. The hook member 110 is in an elongate generally U-shaped form, with an inside leg 112 and an outside leg 114 both of resilient material. The legs 112, 114 are joined to form a closed end 116. When attached to the back panel 130, the hook member 110 assumes a relative position similar to that of the hook member 14 on the back panel 18 of the wallet of the first embodiment (see FIG. 2). That is, the width center line of the hook member 110 is substantially perpendicular to the center of a folded edge 132 formed by the back panel 130 when in the closed position of FIG. 5. The wallet 100 opens and closes about a fold axis B with which the folded edge 132 is substantially coincident.

Attachment of the hook member 110 to the back panel 130 is facilitated by way of a first strip of fastening material 118 adhered to an outside surface of the inside leg 112 of the hook member, and a second strip of fastening material 134 fixed at the attachment area 120 on the back panel 130. The fastening materials 118, 134 can be, for example, mating strips of "VELCRO" type material. To ensure stability of the hook member 110 when attached, a slit opening 136 is formed in the back panel 130 for receiving the width of the free end of the inside leg 112 of the hook member prior to urging the first fastening material strip 118 on the hook member against the second strip 134 on the back panel 130 (see FIG. 7).

As shown in detail in FIG. 7, the back panel 130 is comprised of a first layer of flexible material 138 defining the outside surface of the back panel 130, and a second layer of flexible material 140 defining generally symmetrical inside surface portions of the back panel on opposite sides of the fold axis B. Hook support layer means comprised of a foam layer 142 and a flexible material strip 144 are fixed as by stitching 146 (FIG. 5) between the first and the second flexible material layers 138, 140 on the lower side of the fold axis B as viewed in FIG. 7. The first flexible material layer 138 and the foam layer 142 each have a coincident opening 148. The second strip of fastening material 134 is adhered to the flexible material strip 144 so as to project through the opening 148. The outside surface of the second fastening strip 134 is at most flush or substantially continuous with the surrounding portion of the back panel 130 when the hook member 110 is detached. Thus, the wallet 100 can be placed easily in a shirt or pants pocket when wearing normal street attire and the hook member 110 is removed.

The remaining construction details of the wallet 100 are similar to those for the wallet in the embodiment of FIGS. 2–4 and, thus, need not be repeated here. Parts similar to those of the wallet in the first embodiment are designated by the same reference numerals. Like the two flexible layers 20,22 of the back panel 18 in the first embodiment, the first and the second layers 138, 140 of flexible material in the second embodiment are preferably a nylon or similar fabric which permits air current flow through the fabric. Also, the hook member 110 can be any resilient, rust-resistant metal or plastics material. It is also preferred that the foam layer 142 be glued against the inner surface of the first flexible material layer 138, particularly to prevent separation between the layers 138, 142 in the region of the slit opening 136 which is cut through both layers. That is, the layers 138, 142 should not separate at the slit opening 136 upon repeated insertion and withdrawl of the free end of the hook member inside leg 112.

It will also be appreciated that since the second fastening material strip 134 is contained within the opening 148 in the back panel 130, the hook member 110 will lay flush against the outside surface of the back panel 130 when attached to provide a neat appearance and a minimal cross-sectional thickness for the wallet 100 when closed and worn beneath a waistband.

While the foregoing description represents preferred embodiments of the present invention, it will be obvious to those skilled in the art that various changes and modifications may be made, without departing from the true spirit and scope of the present invention.

What is claimed is:

1. A wallet for use while jogging or the like, comprising:

a back panel of flexible material which is foldable between an open and a closed position about a fold axis so that generally symmetrical inside surface portions of said back panel on opposite sides of said fold axis move toward one another when said back panel is folded toward said closed position, and a linear folded edge substantially coincident with said fold axis is formed by an outside surface of said back panel when at said closed position;

said folded edge measuring at most about 4.0 inches (10.16 cm.);

a first flexible pocket panel secured along peripheral edges thereof to one of said inside surface portions of said back panel to define a first pocket;

a second flexible pocket panel secured along peripheral edges thereof to the opposite one of said inside surface portions of said back panel to define a second pocket;

an elongate generally U-shaped hook member with legs of resilient material of a certain width and having a hook inside surface and a hook outside surface, said hook member projecting outside said back panel with the width center line of the hook member perpendicular to the center of said folded edge, said hook member having a closed end in the vicinity of said folded edge of said back panel when in said closed position, the overall dimensions of said hook member and said back panel being such that the wallet can be worn securely and concealed between a waistband and a wearer's body when said back panel is in said closed position and the waistband is clamped by an outside leg of said hook member up to said closed end;

wherein said back panel is comprised of a first layer of flexible material defining said outside surface and a second layer of flexible material defining said inside surface portions, and a rigid hook support layer between the two flexible material layers on one side of said fold axis; and an inside leg of said hook member extends between said hook support layer and the first layer of flexible material forming said back panel, the hook outside surface on said inside leg being fixed against said hook support layer, and an upper part of said inside leg adjacent the closed end of said hook member projecting out of an opening in the first layer of flexible material.

2. A wallet according to claim 1, including a third pocket panel secured along peripheral edges thereof to said second pocket panel, said third pocket panel having an unsecured edge to define a third pocket.

3. A wallet according to claim 2, including means adjacent the unsecured edge of said third pocket panel for sealing closed said third pocket.

4. A wallet according to claim 3, including means in the vicinity of the unsecured edge of said third pocket panel for releasing said sealing means and opening said third pocket in response to a manually applied force.

5. A wallet according to claim 4, including means fixed to said third pocket panel out of the region of said sealing means, for holding a key both when placed in said third pocket and when the key is withdrawn for use after said third pocket is opened by said releasing means.

6. A wallet according to claim 1, wherein said first pocket panel is transparent to permit viewing of an identification card inserted in said first pocket.

7. A wallet according to claim 1, including abrasive means on the hook inside surface of the outside leg of said hook member, for grasping the waistband of the wearer.

8. A wallet for use while jogging or the like, comprising:

a back panel of flexible material which is foldable between an open and a closed position about a fold axis so that generally symmetrical inside surface portions of said back panel on opposite sides of said fold axis move toward one another when said back panel is folded toward said closed position, and a linear folded edge substantially coincident with said fold axis is formed by an outside surface of said back panel when at said closed position;

said folded edge measuring at most about 4.0 inches (10.16 cm.);

a first flexible pocket panel secured along peripheral edges thereof to one of said inside surface portions of said back panel to define a first pocket;

a second flexible pocket panel secured along peripheral edges thereof to the opposite one of said inside surface portions of said back panel to define a second pocket; and a detachable, elongate generally U-shaped hook member with legs of resilient material of a certain width and having a hook inside surface and a hook outside surface, said hook member being arranged to project outside said back panel with the width center line of the hook member perpendicular to the center of said folded edge, said hook member having a closed end in the vicinity of said folded edge of said back panel when in said closed position, the overall dimensions of said hook member and said back panel being such that the wallet can be worn securely and concealed between a waistband and a wearer's body when said back panel is in said closed position and the waistband is clamped by an outside leg of said hook member up to said closed end;

said back panel being constructed and arranged to engage said hook member firmly at an area of attachment formed in the outside surface of said back panel, wherein said area of attachment is beneath or flush with the surrounding portion of said back panel when said hook member is detached.

9. A wallet according to claim 8, wherein said back panel is comprised of a first layer of flexible material defining said outside surface and a second layer of flexible material defining said inside surface portions, and hook support layer means between said first and said second layers on one side of said fold axis for detachably engaging said hook member, said first layer of flexible material having an opening at said area of attachment to expose a part of said hook support layer means for engaging the hook member.

10. A wallet according to claim 9, wherein said first layer of flexible material and said hook layer support means each has a slit opening the width of said hook member for receiving the free end of an inside leg of said hook member when the hook member engages said support layer means, for securing the hook member against movement relative to said back panel.

11. A wallet according to claim 10, including a first fastening material on the exposed part of said hook layer support means, and a second fastening material on the hook outside surface of the inside leg of said hook member for detachably engaging said first fastening material.

12. A wallet according to claim 11, wherein said hook support layer means comprises a foam layer adjacent said first layer of flexible material and having an opening coincident with the opening in said first layer of flexible material, and a strip of flexible material adjacent said foam layer and on which said first fastening material is secured to project through the coincident openings.

13. A wallet according to claim 8, including a third pocket panel secured along peripheral edges thereof to said second pocket panel, said third pocket panel having an unsecured edge to define a third pocket.

14. A wallet according to claim 13, including means adjacent the unsecured edge of said third pocket panel for sealing closed said third pocket.

15. A wallet according to claim 14, including means in the vicinity of the unsecured edge of said third pocket panel for releasing said sealing means and opening said third pocket in response to a manually applied force.

16. A wallet according to claim 15, including means fixed to said third pocket panel out of the region of said sealing means, for holding a key both when placed in said third pocket and when the key is withdrawn for use after said third pocket is opened by said releasing means.

17. A wallet according to claim 8, wherein said first pocket panel is transparent to permit viewing of an identification card inserted in said first pocket.

18. A wallet according to claim 8, including abrasive means on the hook inside surface of the outside leg of said hook member, for grasping the waistband of the wearer.

* * * * *